United States Patent [19]

Matsuo

[11] 4,185,176

[45] Jan. 22, 1980

[54] CHANGE-OVER SWITCH FOR USE IN HIGH-FREQUENCY ELECTRIC CIRCUITS

[75] Inventor: Toshitaka Matsuo, Kakuta, Japan

[73] Assignee: Alps Electric Co., Ltd., Tokyo, Japan

[21] Appl. No.: 878,402

[22] Filed: Feb. 16, 1978

[30] Foreign Application Priority Data

Feb. 18, 1977 [JP] Japan ..... 52-18683[U]

[51] Int. Cl.[2] ..... H01H 15/00

[52] U.S. Cl. ..... 200/16 D; 200/305; 174/35 R

[58] Field of Search ..... 200/16 C, 16 D, 16 F, 200/304, 305; 273/DIG. 28, 856; 174/35 R

[56] References Cited

U.S. PATENT DOCUMENTS 3,987,263 10/1976 Ogasawara ..... 200/305

*Primary Examiner*—Gene Z. Rubinson
*Assistant Examiner*—Morris Ginsburg
*Attorney, Agent, or Firm*—Guy W. Shoup; Gerard F. Dunne

[57] ABSTRACT

Disclosed is a slide-type change-over switch for use in switching high-frequency electric circuits between TV and selected one of antenna or video tape recorder (or TV game appliance). The switch has a frame, a slider carrying a plurality of movable contacts, an insulating substrate plate carrying a plurality of fixed contacts including input, output, relaying and grounding contacts, and a shielding spring plate secured to the slider. The shielding spring plate has a pair of spring legs adapted to be positioned between the operating fixed output contact and the opened input fixed terminal not in use, so as to electromagnetically isolate these terminals from each other and prevent inductive coupling therebetween. In one embodiment, the shielding spring plate is further provided with a plurality of spring arms which form a shortened grounding path for the shielding spring leg, so as to lower the impedance of the path through which the shielding spring leg is grounded.

9 Claims, 13 Drawing Figures

CHANGE-OVER SWITCH FOR USE IN HIGH-FREQUENCY ELECTRIC CIRCUITS

BACKGROUND OF THE INVENTION

The present invention relates to change-over switches for use in switching high frequency electric signals. More particularly, the invention is concerned with slide type change-over switches having good internal electromagnetic isolation characteristics and thus suitable for use in the switching of high frequency electric circuits, e.g. for selectively connecting an antenna (referred to as ANT), video tape recorder (referred to as VTR) or a TV game appliance to a television receiver (referred to as TV).

Such change-over switches of the slide type for use in high frequency electric circuits have been proposed which include means for preventing leakage or radiation of electromagnetic energy between an output terminal and the opened input terminal, i.e. input terminal which is not in use, thereby to prevent inductive coupling between these two terminals and thus improve the internal isolation characteristics of the switch. However, in change-over switches having such means, the grounding path used to effect the shield is often considerably long and exhibits a correspondingly large impedance, so as to diminish the shielding effect and thus deteriorate the isolation characteristics. Further, such switches are often objectionally complex in manufacture and assembly so as to add costs to production.

SUMMARY OF THE INVENTION

It is therfore an object of the present invention to overcome the above described problems of the prior art by providing a change-over switch in which the grounding path from the shielding means is quite short.

It is another object of the present invention to provide a functional switch with a simple construction.

The above and other objects, as well as advantageous features of the present invention will become clear from the following descriptions taken in conjunction with the attached drawings.

BRIEF DESCRIPTION OF THE DRAWINGS

FIGS. 1 to 6 show a change-over switch for high-frequency use showing one embodiment of the present invention, in which:

FIG. 1 is a side sectional view taken along the line A–A′ of FIG. 2A,

FIG. 3 is an exploded perspective view of the change-over switch, FIG. 4 is a bottom plan view of a slider to which a shield spring plate is secured, FIG. 5 is a side elevational view of the slider of FIG. 4, and FIGS. 6A and 6B are illustrations explanatory of wiring of the switch, and its operation.

DESCRIPTION OF THE PREFERRED EMBODIMENTS

Figure 1:
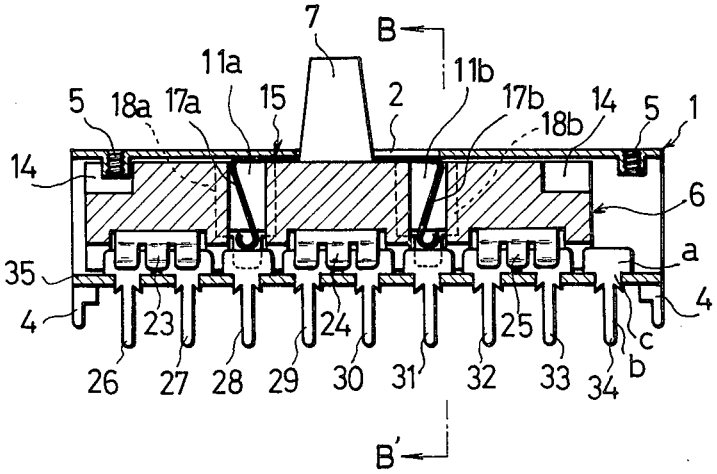
Figure 2A:
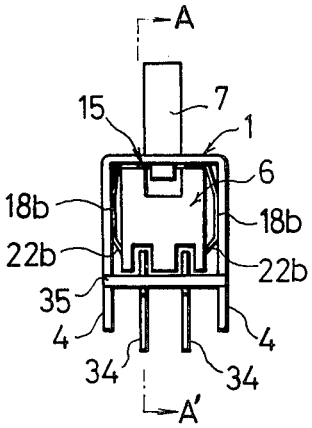
FIG. 2A is a side elevational view of the change-over switch as viewed from a narrow side.
Figure 2B:
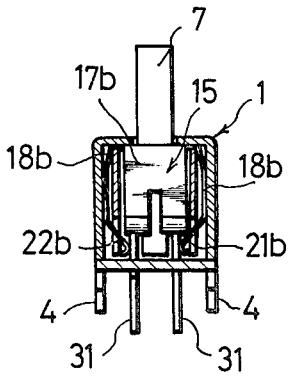
FIG. 2B is a side elevational sectional view of the change-over switch taken along the line B–B′ of FIG. 1.

Referring to FIGS. 1 to 5 showing an embodiment of the present invention, a change-over switch in accordance with the invention, has a substantially inverse U-shaped frame 1 formed of a conductive metallic plate. An operating knob 7 of a slider 6 is passedgthrough the back side of the frame 1, through an elongate slot 2 formed in the back side wall of the frame 1. The slot 2 is adapted to act as a stopper or guide for limiting the movement of the slider 6.

At the lower edges of both leg portions of the frame 1, are formed tabs 3 by means of which an insulating substrate plate is fixed to the frame. Legs 4 are provided for securing the switch to a chassis or to a printed substrate plate. The switch is adapted to be fixed to a panel or the like, by means of screws which can be passed through holes 5.

The slider is made from a nonconductive synthetic plastic material and has the knob 7 projecting from the back side thereof. At the front side of the slider 6, are formed two rows of recesses 8, 9 and 10 of equal size and adapted for receiving movable contacts 23, 24 and 25. Each of the rows includes three contacts 23, 24 and 25, as can be seen most clearly from FIG. 4. Holes 11*a* and 11*b* are for receiving the spring legs 17*a* and 17*b* of the shield spring plate 15 as mentioned further below. The side walls of the slider 6 are notched at both sides of each bore 11*a* and 11*b*, as at 12*a* and 12*b*, so as to receive contacting sections 22*a* and 22*b* of the spring arms 18*a* and 18*b* of the shield spring plate 15. Two rows of grooves 13 are formed in the slider 6 so as to extend in its sliding or longitudinal direction for allowing the insertion of the fixed terminals as will be set forth more fully below. Numeral 14 denotes a notch for providing clearance for the screw holes 5 of the frame 1.

The shield spring plate 15 is made from a thin metallic plate having good resiliency and electrical conductivity, e.g. phosphor-bronze, and has a base section 16, a pair of resilient legs 17*a* and 17*b* bent downwardly from the base section, and four resilient spring arms 18*a* and 18*b* formed by downwardly bending tabs projecting from the longitudinal end portions of the base section 16.

A hole 19 is formed at the center of the base section 16 for passing the knob 7 of the slider 6 therethrough. The free ends of the spring legs 17*a* and 17*b* are bent upwards so as to be generally semi-circular, and are notched as at 20 so as to form two contacting sections 21*a*, and two contacting sections 21*b* for contacting a fixed terminal as will be described below. The spring arms 18*a* and 18*b* are provided with respective contacting tabs 22*a* and 22*b* which are narrowed so as to be received within the notches 12*a* and 12*b* of the slider 6 and adapted to contact at their ends a fixed terminal as will be described below. Numerals 23, 24 and 25 denote clip-like movable contacts of an equal shape and size.

Figure 3:
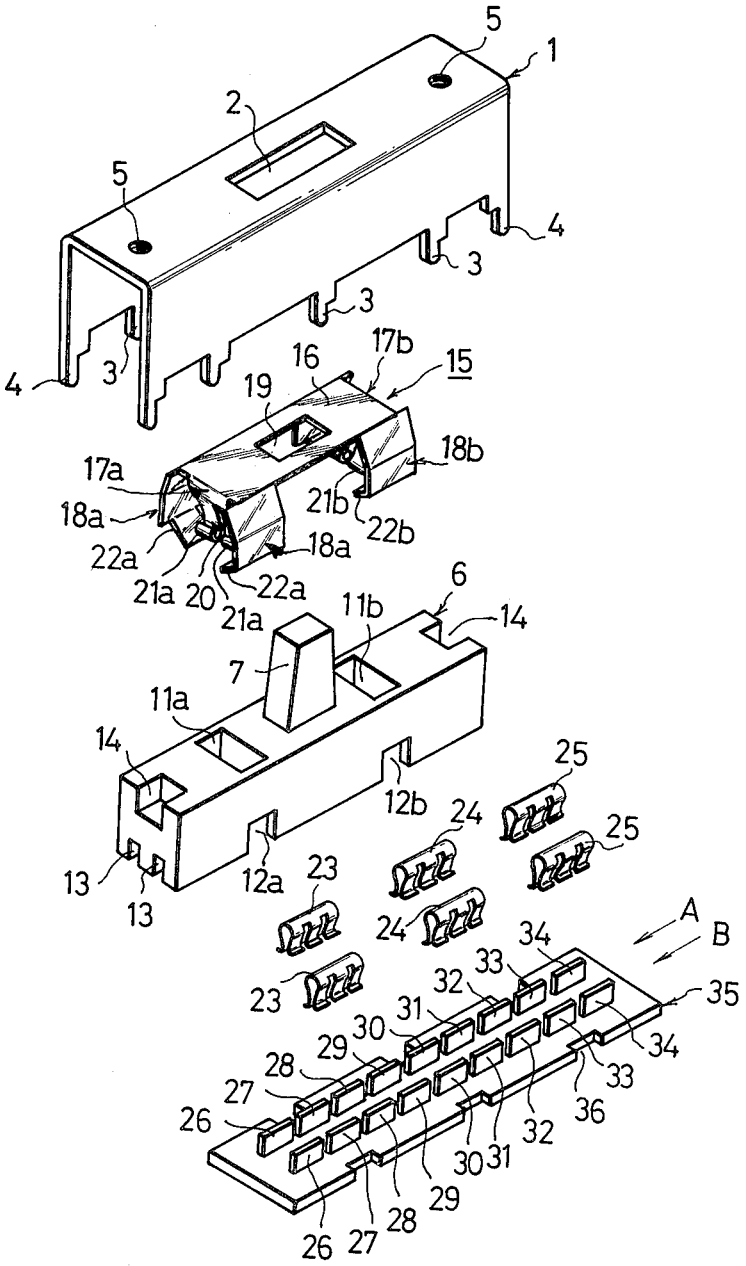
Figure 4:
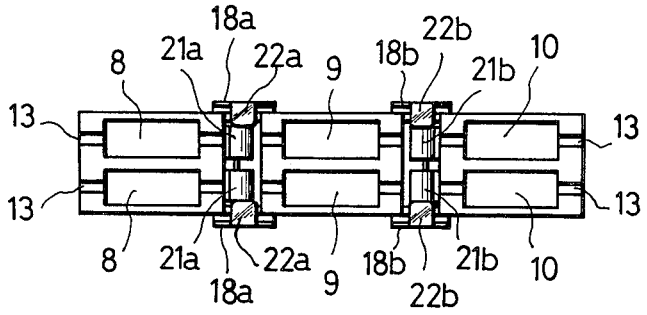
Figure 5:
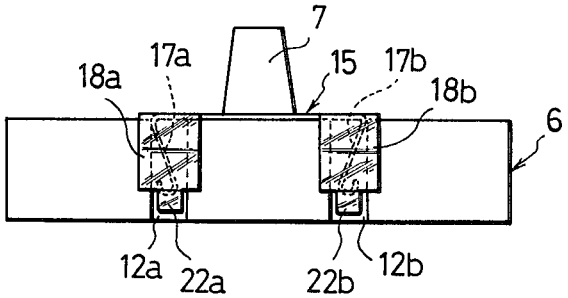

Numerals 26 to 34 inclusive denote fixed terminals of an equal shape and size, which fixed terminals each have a fixed contact section a which the movable contacts are adapted to contact, a terminal section b and a caulking section c (see FIG. 1). These fixed terminals are inserted into two rows of holes (not shown) in the substate plate, from their terminal sections b, and then the caulking sections c are fitted and caulked so as to fix the terminals to the substrate plate 35, thereby to form two rows of fixed terminals A and B as shown in FIG. 3.

In assembling, first the knob 7 of the slider 6 is passed through the hole 19 of the shielding spring plate 15, while the spring legs 17*a* and 17*b* are inserted into the holes 11*a* and 11*b* of the slide 6, respectively. At the same time, the contacting tabs 22*a* and 22*b* of the spring arms 18*a* and 18*b* are inserted into the notches 12*a* and 12*b* formed at both side portions of the slider 6, thereby to secure the shielding spring plate 15 to the slider. Subsequently, the slider 6, which has two rows of movable contacts 23, 24 and 25 received in its two rows of recesses 8, 9 and 10, is placed inside the frame 1, and the knob 7 of the slider 6 is made to project out of the frame through the slot 2 formed in the latter, in such a manner that the knob 7 is slidable within the slot 2. Then, the tabs 3 of the frame 1 are made to engage the notches 36 formed in the side edges of the insulating substrate plate 35, which carries the two rows A and B of the fixed terminals. Then, the ends of the tabs 3 are bent to fix the insulating substrate plate 35 to the frame 1, thereby to complete the assembling of the switch.

A set of switching contacts is formed by a set of movable contact (3 in each set) and one row of fixed terminals (9 terminals in each row), in the assembled change-over switch. The arrangement is such that the movable contact 23 is adapted to make a sliding contact with particular ones of the fixed terminals 26, 27, 28. Similarly, the movable contacts 24 and 25 are associated with the groups of fixed terminals 29, 30, 31 and 32, 33, 34, respectively.

An example of wiring for connection of ANT and VTR (or TV game appliance) to TV, through the change-over switch of the described embodiment will be explained hereinafter, with reference to FIG. 6. In FIG. 6, the same reference numerals denote parts corresponding to those of FIGS. 1 to 5. In the example of wiring as shown in FIG. 6 two rows A, B of the fixed contacts are used in parallel with each other. Terminals 26 and 34 are used as input fixed terminals, while numeral 30 is used as the output fixed terminal. Terminals 28 and 32 are used as the grounding terminals, and the terminals 27, 29, 31 and 33 are used as relay fixed terminals. The relay fixed terminal 27 is connected to the relay fixed terminal 29, while relay fixed terminal 31 is connected to the relay fixed terminal 33, at their terminal sections c. At the same time, the relay fixed terminal 27 of the row A is connected to the corresponding terminal 27 of the row B. Similarly, the relay fixed terminal 33 of row A is connected to the corresponding terminal 33 of the row B. Input fixed terminals 26 and 34 of one row are connected to VTR and ANT, respectively, while the output fixed terminal 30 of the same row is connected to TV. The grounding fixed terminals 28 and 32 are grounded to the frame 1.

At the same time, the spring arms 18*a* and 18*b* of the shield spring plate 15 are kept in contact with the frame 1, so as to ground the shielding spring plate 15.

Figure 6A:
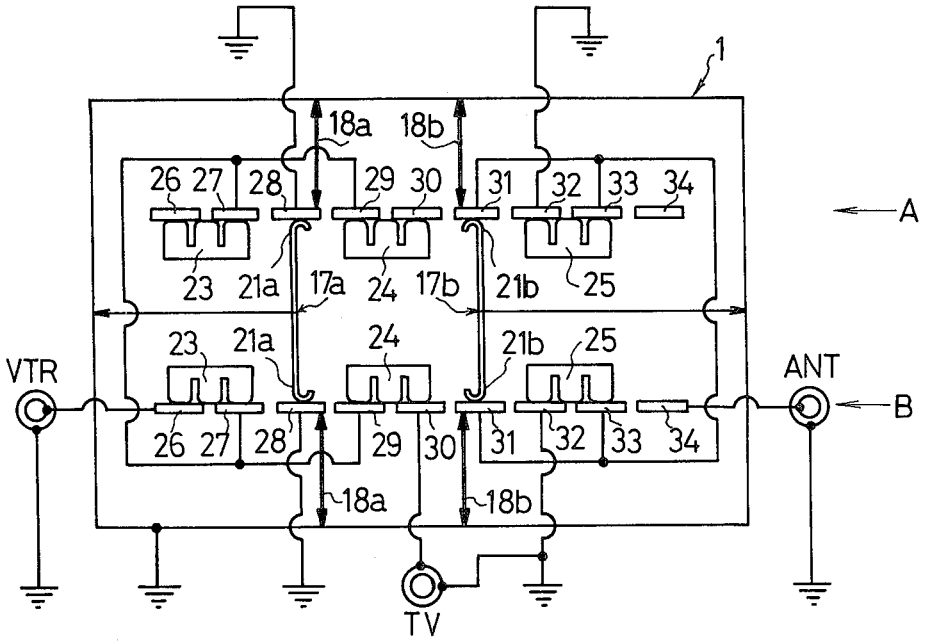

In operation, referring to FIGS. 6A, when the knob 7 of the slider 6 is slid along the slot 2 of the frame 1, so as to contact the left-hand side edge of the latter as viewed in FIG. 1, the movable contact 23 short-circuits the input fixed terminal 26 and the relay fixed terminal 27, while the movable contact 24 short-circuits the relay fixed terminal 29 and the output fixed terminal 30. Meanwhile, the grounding fixed terminal 32 is short-circuited to the relay fixed terminal 33 through the movable contact 25. Thus, the input fixed terminal 26 is connected to the output fixed terminal 30, through movable contacts 23, 24 and the relay fixed terminals 27, 29.

Therefore, VTR is connected to TV, while the input fixed terminal 34 connected to ANT is electrically isolated and kept in the opened state. The relay fixed terminals 31 and 33 are grounded through the grounding fixed terminal 32.

The shielding spring plate 15 is grounded also through the fixed terminal side, because the contacting sections 21*a* and 21*b* of the spring legs 17*a* and 17*b* make contact with the grounding fixed terminal 28 and the relay fixed circuit 31, respectively. In addition, the spring arms 18*a* and 18*b* are in contact with the inner surface of the side wall of the frame 1, and the contacting tabs 22*a* and 22*b* of the spring arms 18*a* and 18*b* are making contact with the grounding fixed terminal 28 and the relay fixed terminal 31, respectively. The relay fixed terminal 31 is thus grounded by the smallest distance, through the spring arm 18*b* and the frame 1. At the same time, the spring leg 17*b* is positioned between the output fixed terminal 30 and the input fixed terminal 34, while the fixed terminals 31, 32, and 33 are grounded.

Therefore, the opened input fixed terminal 34 is electromagnetically isolated from the operating fixed terminal side, so as to ensure a good isolation, thereby to prevent the leak of electromagnetic radiation from the output side which would, otherwise, be reversingly radiated from ANT.

Figure 6B:
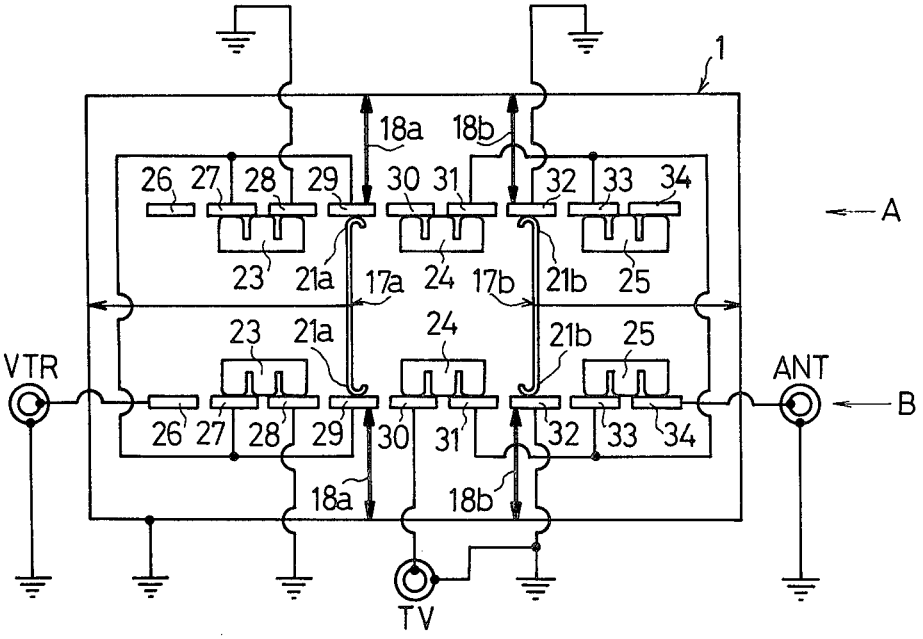

Then, as the knob 7 of the slider 6 is slid rightwardly as viewed on the drawings, until it comes into contact with the right-hand side end of the slot 2 of the frame 1, the movable contact 23 leaves the input fixed terminal 26, as seen from FIG. 6B, and comes to short-circuit the relay fixed terminal 27 and the grounding fixed terminal 28. Also, the movable contact 24 leaves the relay fixed terminal 29 and comes to short-circuit the output fixed terminal 30 to the relay fixed terminal 31. Similarly, the movable contact 25 leaves the grounding fixed terminal 32 and comes to short-circuit the relay fixed terminal 33 to the input fixed terminal 34. Consequently, the input fixed terminal 34 is connected to the output fixed terminal 30 through the movable contacts 24, 25 and the relay fixed terminals 31, 33. That is, ANT is connected to TV, while the input terminal connected to VTR is electrically isolated.

At the same time, the shielding spring plate 15 is moved along with the slider 6, so that the contacting sections 21*a* and 21*b* of the spring legs 17*a* and the contacting tabs 22*a* and 22*b* of the spring arms 18*a* and 18*b* leave the grounding fixed terminal 28 and the relay fixed terminal 31, respectively, and come to the relay fixed terminal 29 and the grounding terminal 32. In this state, the spring leg 17*a* of the shielding spring plate 15 is positioned between the opened input fixed terminal 26 and the operating output fixed terminal 30, and the fixed terminals 27, 28 and 29 are grounded so as to ensure a good electromagnetic isolation.

Figure 7:
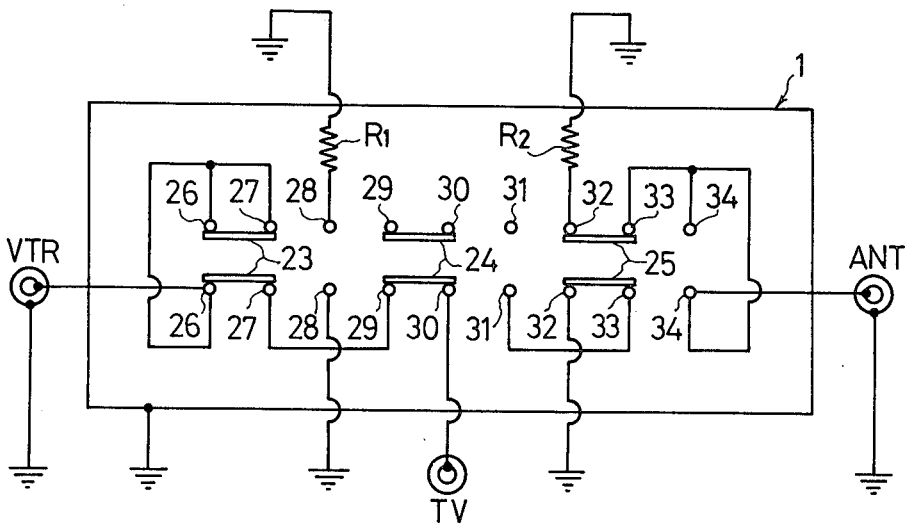
FIG. 7 is an illustration of another example of the wiring of the switch.

The wiring as shown in FIGS. 6A and 6B is not exclusive, and the switch of the described embodiment can be used along with the wiring as shown in FIG. 7.

Referring to FIG. 7, ANT, VTR and TV are connected to the switch through coaxial cables (75 Ω) and grounding resistance $R_1$, $R_2$ (75 Ω each) are attached to the switch side.

Figure 8:
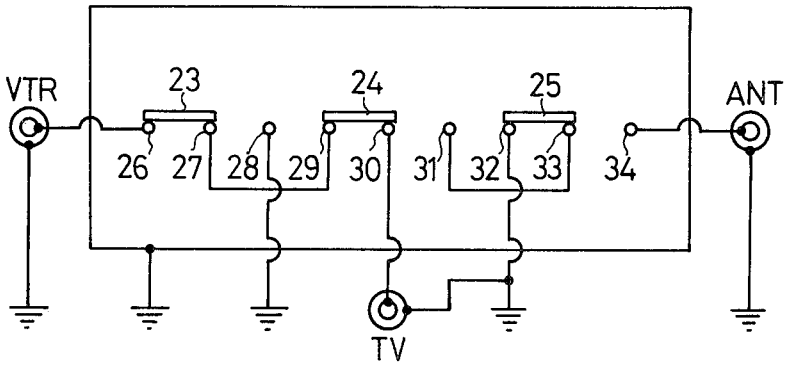
FIG. 8 is a wiring diagram of the switch in accordance with the invention in which the fixed terminals are arrayed in single row.

Although the embodiment of FIGS. 1-7 have been described as having two rows A and B of fixed terminals, it is of course possible to carry out the present invention with a switch having only one row of fixed terminals. In such a case, needless to say, the switch can be used for selectively connecting either one of ANT and VTR to TV, by the wiring as shown in FIG. 8 which is identical to that for the row B as shown in FIG. 6.

Figure 9:
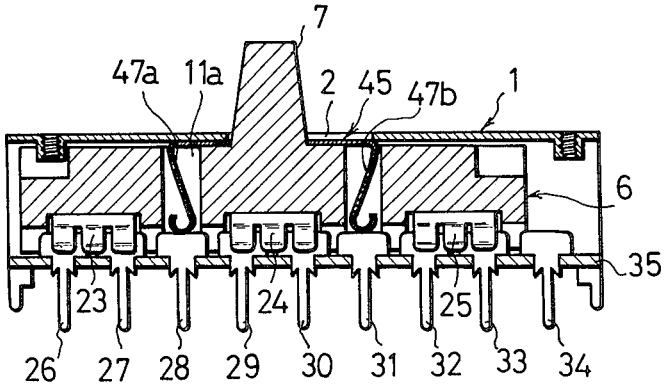
FIG. 9 is a sectional side elevational view of another embodiment of the present invention.
Figure 10:
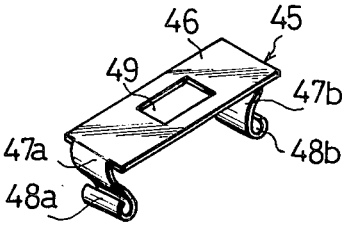
FIG. 10 is a perspective view of the shield spring incorporated in the switch of FIG. 9.
Figure 11:
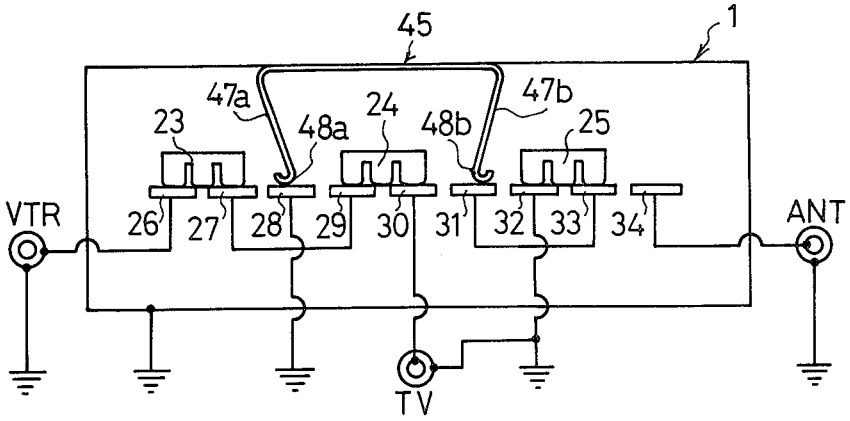
FIG. 11 is a wiring diagram of the switch of FIG. 9.

In FIGS. 9 to 11, showing another embodiment, the same numerals denote parts corresponding to those of FIGS. 1 to 6. For simplification, the switch is assumed to have only one row of nine fixed terminals, which correspond to the wiring for the row B of FIG. 6 and wiring of FIG. 8. The switch, of course, may have two rows of fixed terminals ganged together. Referring to FIGS. 9 to 11, a shielding spring plate 45 has a base section 46 and spring legs 47*a* and 47*b*.

The spring legs 47*a* and 47*b* are provided with contacting portions 48*a* and 48*b*. The shielding spring plate 45 is secured to a slider 6 in such a manner that a knob 7 of the slider is received by a hole 49 formed in the base section 46, while spring legs 48*a* and 48*b* are inserted into bores 11*a* and 11*b* of the slider 6. The base section 46 is made to slidingly contact the top of the frame 1.

In this change-over switch, TV is connected to VTR as shown in FIG. 11 when the slider 6 is positioned at the left position as shown in FIG. 9, and the spring leg 47*b* of the shield spring plate 45 is positioned between the operating output fixed terminal 30 and the opened input fixed terminal 34 so as to provide a shield therebetween for electromagnetic radiation. In this state, the spring leg 47*b* is grounded through the following three grounding paths.

A first grounding path (i) is constituted by the base section 46, top panel of the frame 1 and the side wall of the latter. A second grounding path (ii) is constituted by the base section 46, spring leg 47*a* and the grounding fixed terminal 28. A grounding path (iii) is constituted by relay fixed terminals 31, 33, movable contact (25) and the grounding fixed terminal 32.

All of these grounding circuits, however, make large detours and have correspondingly large impedance. Especially, the grounding path (ii) which forms a loop, so as to possess an extremely high impedance. The switch of FIG. 9-11, however, is much simpler than those of the prior art to manufacture.

The high impedance of these grounding paths inevitably leads to a lesser shielding effect of the shielding spring plate 45. Consequently, the embodiment shown in FIGS. 1-6 is preferred.

According to the embodiment shown in FIGS. 1-6, the spring leg 17*b* can be grounded through a grounding path constituted by the spring arm 18*b* which short-circuits the relay fixed terminal 31 to the side of the frame 1, when the slider 6 is located at the position as shown in FIG. 1, as will be seen from the row B of FIG. 6A. This grounding path, afforded by the provision of the spring arms 18*a* and 18*b*, is much shorter than any one of the earthing paths (i) to (ii) of the switch of FIGS. 9-11, and exhibits a much reduced impedance, ensuring much larger shielding effects.

The embodiment shown in FIGS. 9-11 is quite simple to manufacture and functions quite well. The shield spring plate can be incorporated in the switch simply by fitting it over the slider, as in the embodiment of FIGS. 1-6. Also, the arrangements of one or two rows of nine fixed contacts provides a switch wherein appreciable electromagnetic isolation can be attained.

Having described the invention through specific embodiments, it is to be noted here that the described embodiments are not exclusive, but various changes and modifications may be imparted thereto without substantially departing from the spirit and scope of the present invention which is defined by the appended claims.

What is claimed is:

1. A switch for use in switching high-frequency electric signals, comprising:
   - an elongate frame comprised of an electrically conductive material;
   - a substrate plate fixed to said frame and comprised of an electrically insulating material;
   - at least one row of fixed terminals carried by said substrate plate, each said row including
     - an output terminal,
     - two input terminals spaced in opposing directions from said output terminal and
     - grounding terminals each adapted to be connected to electrical ground and located between said output terminal and a respective input terminal;
   - a slider received slidably within said frame and carrying one set of movable contacts for each said row for alternatively connecting one or the other of said input terminals with said output terminal of the same row; and
   - means carried by said slider for shielding each said input terminal from electromagnetic radiation from the other of the same row, said shielding means including
     - first and second leg portions each comprised of a resilient conductive material, said leg portions each being positionable by said slider whereby contact portions of one of said leg portions will engage the grounding terminal between said output terminal and the input terminal connected electrically thereto by said movable contacts, and
     - arm portions comprised of a resilient conductive material and slidingly contacting the inner surface of said frame, said arm portions also each being positionable by said slider whereby tab portions of some of said arm portions will engage the same grounding terminal engaged by a contact portion of said one leg portion.

2. A switch according to claim 1, said shielding means further including a base portion extending across the top of said slider and interconnecting said first and second leg portions, said base portion being comprised of an electrically conductive material and slidingly contacting the inner surface of said frame.

3. A switch according to claim 2, said base portion, leg portions and arm portions being unitarily formed from a sheet of metal.

4. A switch according to claim 1,
   - each said row further includes relay terminals disposed respectively between adjacent ones of said output terminal, said input terminals and said grounding terminals;
   - each said set of movable contacts comprises a first, second and third movable contact, one of said first and third movable contacts being adapted to engage one of said input terminals and a relay terminal adjacent thereto while the other of said first and third movable contacts engages the relay terminal adjacent to the other of said input terminals and the grounding terminal adjacent to said relay terminal adjacent to the other of said input terminals, said second movable contact adapted to connect said output terminal alternatively with relay terminals on either side of said output terminal;

said relay terminals on either side of said output terminal being respectively connected electrically to the relay terminals on the other side of the adjacent grounding terminal.

5. A switch according to claim 4, wherein the other of said leg portions and others of said arm portions will engage the relay terminal adjacent to said output terminal and on the same side thereof as the non-engaged input terminal so as to be also connected to electrical ground.

6. A switch according to claim 5, wherein there are two rows ganged together.

7. A switch for use in switching high-frequency electric signals, comprising:

an elongate frame comprised of an electrically conductive material;

a substrate plate fixed to said frame and comprised of an electrically insulating material;

at least one row of fixed terminals carried by said substrate plate, each said row comprising an output terminal, two input terminals spaced in opposing directions from said output terminal, grounding terminals each adapted to be connected to electrical ground and located between said output terminal and a respective input terminal and relay terminals disposed respectively between adjacent ones of said output terminal, said input terminals and said grounding terminals;

a slider received slidably within said frame and carrying one set of movable contacts for each said row for alternatively connecting one or the other of said input terminals with said output terminal of the same row;

each said set of movable contacts comprises a first, second and third movable contact, one of said first and third movable contacts being adapted to engage one of said input terminals and a relay terminal adjacent thereto while the other of said first and third movable contacts engages the relay terminal adjacent to the other of said input terminals and the grounding terminal adjacent to said relay terminal adjacent to the other of said input terminals, said second movable contact adapted to connect said output terminal alternatively with relay terminals on either side of said output terminal;

said relay terminals on either side of said output terminal being respectively connected electrically to the relay terminals on the other side of the adjacent grounding terminal and;

means carried by said slider for shielding each of said input terminals from electromagnetic radiation from the other of the same row, said shielding means comprising first and second leg portions each comprised of a resilient conductive material, said leg portions each being positionable by said slider whereby contact portions of one of said leg portions will engage the grounding terminal between said output terminal and the input terminal connected electrically thereto by said set of movable contacts and the other of said leg portions will engage the relay terminal adjacent to said output terminal and on the same side thereof as the non-engaged input terminal so as to be also connected to electrical ground.

8. A switch according to claim 7, said shielding means further including a base portion extending across the top of said slider and interconnecting said first and second leg portions, said base portion being comprised of an electrically conductive material and slidingly contacting the inner surface of said frame.

9. A switch according to claim 7, wherein there are two rows ganged together.

* * * * *